US006902479B1

(12) United States Patent
D'Avanzo

(10) Patent No.: US 6,902,479 B1
(45) Date of Patent: Jun. 7, 2005

(54) ELECTRONIC GAMING MACHINE

(76) Inventor: Scott D'Avanzo, 36 Lewiston Ct., Ladera Ranch, CA (US) 92694

( * ) Notice: Subject to any disclaimer, the term of this patent is extended or adjusted under 35 U.S.C. 154(b) by 0 days.

(21) Appl. No.: 10/717,703

(22) Filed: Nov. 19, 2003

(51) Int. Cl.[7] ..... A63F 5/02; A63F 3/06; G07F 17/34

(52) U.S. Cl. ..... 463/18; 463/19; 463/20; 463/17; 463/16; 463/22; 273/269; 273/138.2; 273/138.1; 273/143 R; 273/144 B; 273/142 E; 273/144 R

(58) Field of Search ..... 463/18, 19, 20, 463/17, 16, 25, 46, 22; 273/269, 138.2, 138.1, 273/143 R, 144 A, 144 R, 144 B, 142 E

(56) References Cited

U.S. PATENT DOCUMENTS

| | | | | | |
|---|---|---|---|---|---|
| 4,871,171 | A | | 10/1989 | Rivero | |
| 5,121,920 | A | * | 6/1992 | Laezzo et al. | 273/144 B |
| 5,360,214 | A | | 11/1994 | Harmen | |
| 5,639,089 | A | * | 6/1997 | Matsumoto et al. | 273/142 E |
| 5,823,534 | A | * | 10/1998 | Banyai | 273/269 |
| 5,823,874 | A | | 10/1998 | Adams | |
| 5,845,903 | A | * | 12/1998 | Sloan | 273/144 R |
| 5,848,932 | A | | 12/1998 | Adams | |
| 5,882,261 | A | | 3/1999 | Adams | |
| 6,089,978 | A | | 7/2000 | Adams | |
| D431,843 | S | | 10/2000 | Seelig et al. | |
| 6,159,097 | A | | 12/2000 | Gura | |
| 6,270,407 | B1 | * | 8/2001 | Dodge | 463/18 |
| 6,334,814 | B1 | | 1/2002 | Adams | |
| 6,358,146 | B1 | | 3/2002 | Adams | |
| 6,450,884 | B1 | | 9/2002 | Seelig et al. | |
| D470,539 | S | | 2/2003 | Seelig et al. | |
| 6,533,660 | B2 | | 3/2003 | Seelig et al. | |
| 6,582,307 | B2 | * | 6/2003 | Webb | 463/22 |
| 2002/0065126 | A1 | | 5/2002 | Miller et al. | |

* cited by examiner

*Primary Examiner*—Benjamin Layno
(74) *Attorney, Agent, or Firm*—Quirk & Tratos; Rob L. Phillips

(57) ABSTRACT

A gaming machine comprising a container for holding a plurality of numbered balls which are agitated by an air source. A plurality of compartments incorporated on a rotatable wheel in communication with the container capture one or more of the numbered balls. Each of the numbered balls or certain identified captured balls are used to determine a gaming machine award. Certain captured balls may be identified by one or more pointers positioned about the container. In a keno version of the gaming machine a player is afforded the opportunity to select one or more keno numbers using a player interface. An award is then determined based on the numbers on the captured balls and the selected keno numbers. The balls are captured by opening one or more access doors blocking the compartments thereby exposing the balls to a vacuum in the compartment.

32 Claims, 4 Drawing Sheets

ELECTRONIC GAMING MACHINE

FIELD OF INVENTION

The embodiments of the present invention relate generally to electronically implemented gaming machines. More particularly, a gaming machine incorporating a secondary or bonus game.

BACKGROUND

Slot machines, video poker machines, keno machines and other gaming machines have taken over the floors of most casinos. More and more people are playing gaming machines because they are easy to learn, require little or no skill and provide large returns (e.g., 98% of the money played). In addition, gaming machines include themes aimed at attracting new players and retaining experienced players.

One recently developed successful feature of gaming machines is the secondary or bonus game. A secondary game electrically communicates with a gaming machine primary game and is actuated upon certain preestablished primary game outcomes. For example, in a slot machine, the primary game outcome is conventionally determined by a series of mechanical or video reels, depicting gaming indicia, and one or more paylines.

One example of a popular slot machine incorporating a primary and secondary game is the popular Wheel of Fortune® slot machine: The Wheel of Fortune® slot machine includes a primary game comprising mechanical reels and a secondary game facilitated by a rotatable wheel analogous to the "wheel" associated with the game show of the same name. The secondary game is activated in response to a specific preestablished primary game outcome. In practice the specific primary game outcome occurs when the third reel payline of the primary game intersects a "spin the wheel" indicia. In fact, only the third reel includes a "spin the wheel" indicia. After the "spin the wheel" indicia appears, the player depresses a "spin the wheel" button causing the mechanical secondary wheel to spin thereby resulting in random secondary award.

Secondary games have become very popular because players enjoy the excitement and the extra opportunity to win an additional award. Moreover, the secondary games are conventionally programed to result in a winning outcome on each activation. However, the secondary game are typically mundane games such as wheels spinning or numbers randomly illuminating. Moreover, many secondary games have no player interaction. Therefore, players desire more exciting secondary games which provide player participation.

SUMMARY

Accordingly, the embodiments of the present invention are facilitated by an electronic gaming machine incorporating a secondary game in communication with a primary game. The primary game may be in the form of a slot machine, having mechanical or video reels, a video poker machine, keno machine or other electronically implemented game. The secondary game takes the well-known form of a container of numbered balls which when activated are agitated by an air source.

While the use of a container of numbered balls, which are agitated by an air source, for a secondary game is well-known, the use normally comprises one or two pre-selected balls from a concealed location being presented to the player. The presented numbered balls are then used to determine the amount of the secondary award. For example U.S. Pat. No. 5,823,874 to Adams discloses such a system. Therefore, the container of balls being agitated is for show and ultimately has no bearing on the outcome. Additionally, players have no input regarding the balls presented.

The embodiments of the present invention utilize agitated numbered balls to determine a secondary award and in certain embodiments provide player interaction. Accordingly, a container of numbered balls in communication with an air source and a rotatable wheel having a plurality of ball compartments. The rotatable wheel circumscribes a perimeter of the container such that the balls are able to enter the compartments in a random fashion.

More particularly, the container is hemispherical and projects from a top portion of the gaming machine. Ideally, the rotatable wheel is positioned flush with the gaming machine within the container. In this manner, as the wheel rotates and the balls are agitated by the air source, balls are randomly captured by the plurality of compartments when one or more access doors open allowing a ball to enter the compartment. When opened, a vacuum inside the compartment pulls in a random ball.

In one embodiment, multiple pointers about the wheel identify one or more winning balls. The numbers on the identified balls are summed to determine a bonus award or act as multipliers to enhance a primary game award. Alternatively, in a keno embodiment there are 80 balls each depicting a unique number between 1–80. Additionally, in the keno embodiment the gaming machine incorporates a keno grid allowing a player to pre-select his or her desired numbers, An award is then based on the number of matches between the selected numbers and the numbers on the randomly captured balls.

The embodiments disclosed above and other embodiments are described in more detail hereinafter.

DETAILED DESCRIPTION

The operation of electronic gaming machines, including slot machines and video poker machines, are well known in the industry so that the minute details are not set forth herein. In general terms, slot machines and vide poker machines are controlled by processors including, or in communication with, a random number generator. The random number generator generates machine outcomes.

Figure 1:
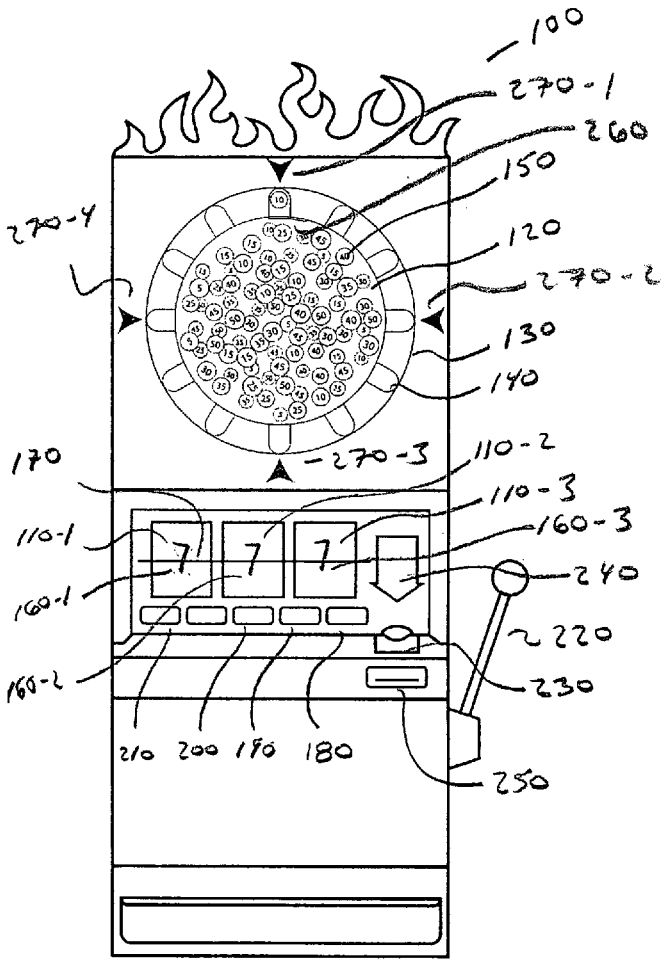
FIG. 1 shows a front view of a slot machine having a secondary game in the form of a hemispherical container, rotatable wheel and a plurality of numbered balls.
Figure 2:
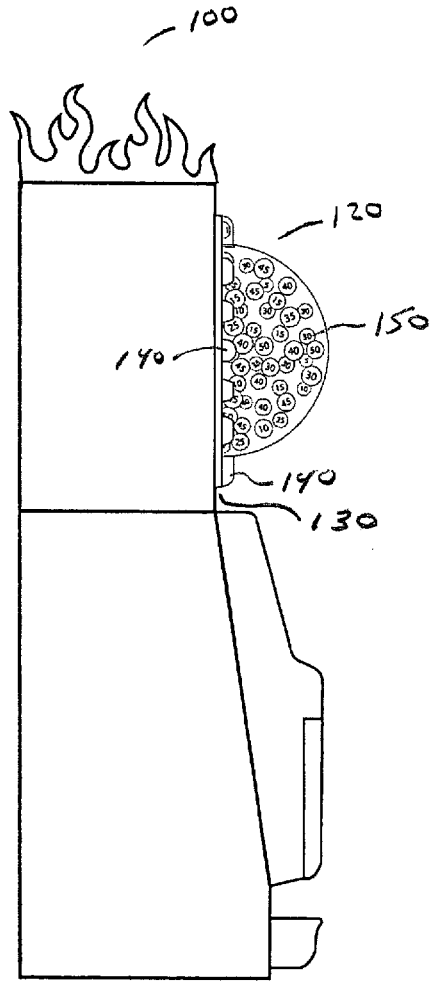
FIG. 2 shows a side view of the gaming machine of FIG. 1.

Reference is now made to the figures wherein like parts are referred to by like numerals throughout. FIGS. 1 and 2 illustrate a front and side view, respectively, of a slot machine, generally denoted by reference numeral 100, for facilitating some of the embodiments of the present invention. The slot machine 100 incorporates a primary wagering game, utilizing multiple reels 110-1 through 110-3, and a secondary game utilizing a container 120, rotatable wheel 130 having multiple ball compartments 140 and a plurality of numbered balls 150. While only three reels 110-1 through 110-3 are shown, more or less than three reels may be utilized to enable the primary wagering game. For example, two, four or five reels may be utilized as well. In addition, the reels 110-1 through 110-3 may be embodied in a mechanical or video format.

The three reels 110-1 through 110-3 include a series of gaming indicia 160-1 through 160-3 on each reel 110-1 through 110-3. Upon activation, the three reels 110-1 through 110-3 spin until each reel from left to right is stopped by a machine processor at preestablished positions. A pay line 170 defines winning primary game outcomes. While only a single pay line 170 is shown, multiple pay lines, including diagonal and zig-zag pay lines, may be incorporated. Based on the alignment of the gaming indicia 160-1 through 160-3 along the pay line 170 the processor determines a player's winnings, if any.

The slot machine 100 includes several player buttons which act as interfaces between the player and the machine processor. Player buttons include a reel activation button 180, a play one credit button 190, a play maximum credits button 200 and a secondary game activation button 210. Instead of the reel activation button 180 a player may activate the reels by means of a slot machine arm 220. Each of the player buttons and the arm 220 are in electrical communication with the processor such that the player may communicate his or her intentions with the machine processor. A player may also interface with the processor through a touchscreen system.

The machine 100 also incorporates a coin acceptor 230 and a credit display 240. Players may insert vouchers or bills via bill acceptor 250. The credit display 240 allows players to play on credit such that any gaming wins or loses are immediately depicted on the display 240. Once a playing session ends, the player may cash out for any monies owed. While not shown, the machine 100 may also incorporate a ticket dispenser for printing tickets for redemption at a cashier window. Such cashless systems are becoming increasingly popular in many gaming jurisdictions.

In practice, the secondary or bonus game is activated in response to preestablished primary game outcomes. Upon activation, the plurality of numbered balls 150 are agitated by an air source (not shown) in communication with the container 120. As shown in FIG. 2, the container 120 may located entirely outside of the confines of the upper portion of the slot machine 100. That is, the container 120 takes the form of one-half of a sphere with the rotatable wheel 130 flush with the upper portion of the slot machine 100. In a first embodiment, once the balls 150 are agitated, the rotatable wheel 130 begins to incrementally rotate so that each compartment 140 temporarily communicates with a suction or vacuum source (not shown) until a numbered ball 150 is captured by a subject compartment 140. A motor (not shown) in communication with the wheel 130 provides a means of rotating the wheel 130. Then, the wheel 130 rotates so that each other compartment 140 may capture a numbered ball 150. An access door 260 positioned at twelve o'clock systematically opens to reveal an opening between the compartment 140 and container 120 to permit the suction or vacuum source to pull a numbered ball 150 into each compartment 140. Once the wheel 130 rotates the container prevents the captured balls 150C from exiting the compartments 140. After the game is played, the access door 260 is opened to allow the captured balls 150C to be deposited from each compartment 140 back into the container 120. This method of using a suction and accessible opening is similar to a traditional keno ball container used throughout the casino industry.

Figure 3:
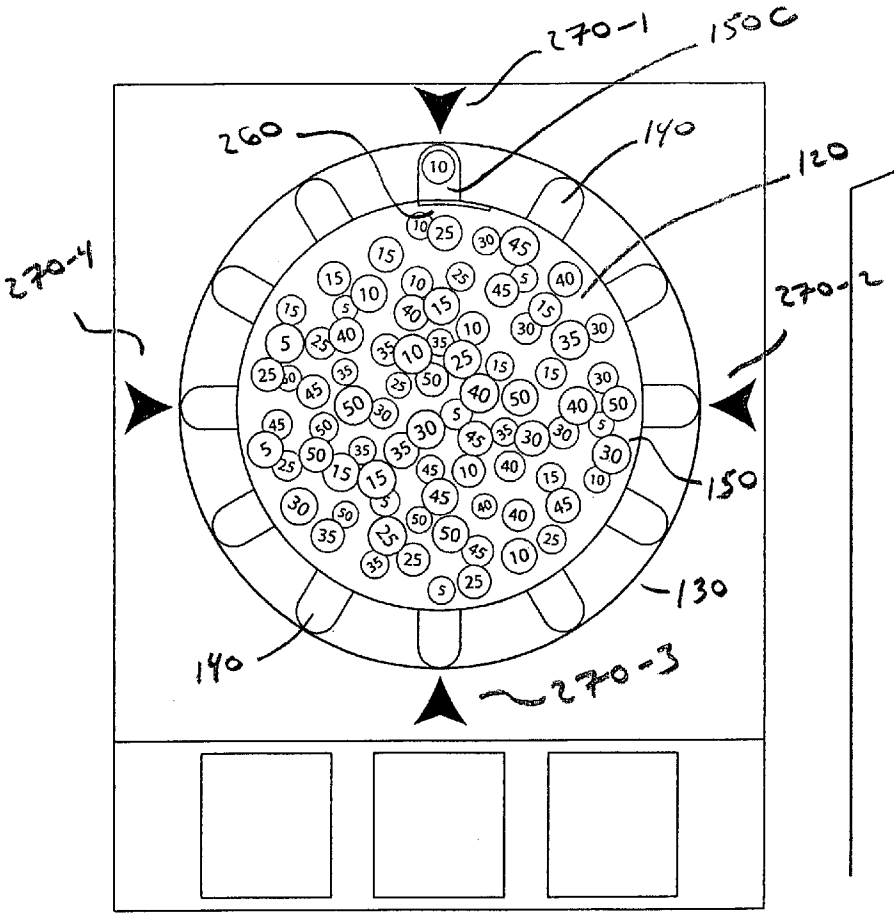
FIG. 3 shows a close-up front view of the hemispherical container, rotatable wheel and plurality of numbered balls.

Continuing with the first embodiment, after each compartment 140 captures a numbered ball 150 the rotatable wheel 130 may spin quickly to create anticipation and excite the player and finally stop at a pre-established position. One or more pointers 270-1 through 270-4 positioned around the container 120 and compartments 140 then identify which captured balls 150C are then used to determine the secondary or bonus award. The pointers 270-1 through 270-4 during activation of the container 120 may be determined by the primary game outcome or randomly by the processor. Therefore, one, two, three or four pointers 270-1 through 270-4 may be active during the play of the secondary game. The pointers 270-1 through 270-4 which are active may be illuminated or otherwise highlighted to alert the player. Therefore, any single pointer 270-1 through 270-4 or combination of pointers shown in FIG. 3 may be used to determine an award.

Bar code symbols on the balls 150, video technologies and other means provide a system for the informing the processor which ball 150 is in which compartment 140 so that the processor can ensure the proper balls 150 are identified by the pointers 270-1 through 270-4. In other words, the award amount is first determined by the random number generator and then the processor controls the operation of the wheel 130 and pointers 270-1 through 270-4 to generate the preestablished award.

To increase the speed at which the balls 150 are captured, more than one access door 260 and corresponding opening may be incorporated about the wheel 130 (e.g., twelve o'clock, three o'clock, six o'clock and nine o'clock). In this manner, each opening is placed in communication with a suction or vacuum. Any number of access doors 260 and corresponding openings are conceivable.

In another embodiment, the pointers 270-1 through 270-4 may be integrated on a rotatable unit about a perimeter of the container 120 and compartments 140 so that the rotatable unit rotates in an opposite or the same direction as the rotation of the wheel 130 and compartments 140. Alternatively, the wheel 130 and compartments 140 may remain stationary while the pointers 270-1 through 270-4 rotate and randomly stop thereabout. For example, each of the balls 150C captured by a compartment 140 and identified by an active pointer 270-1 through 270-4 may be summed to determine a bonus award. Alternatively, the identified captured ball or balls 150 may be used to multiply a primary game award. Any number of other award schemes are possible. Moreover, any number of pointers may be incorporated around the container 120 and compartments 140 to facilitate the particular award scheme.

Figure 4:
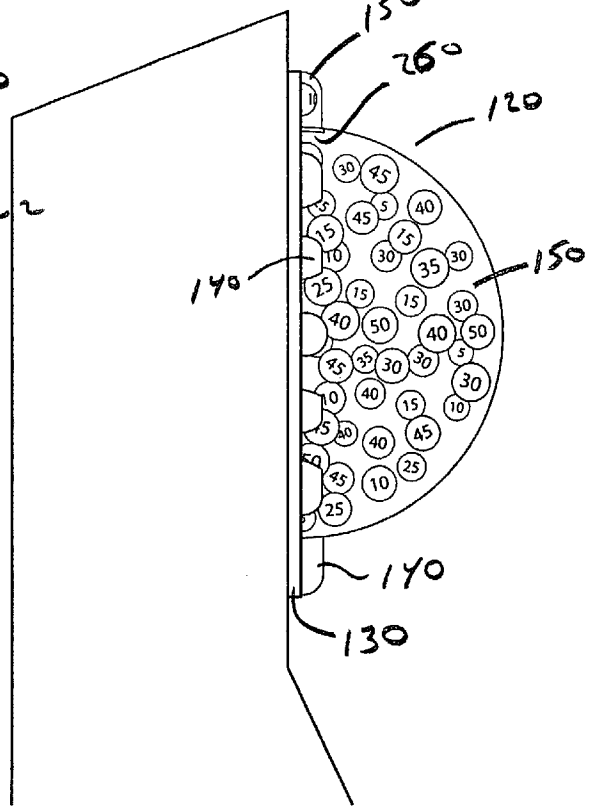
FIG. 4 shows a close-up side view of the hemispherical container, rotatable wheel and plurality of numbered balls

FIG. 4 shows a side view of the container 120, rotatable wheel 130 and the plurality of balls 150. Other wheel configurations are possible without departing from the spirit and scope of the embodiments of the present invention.

Figure 5:
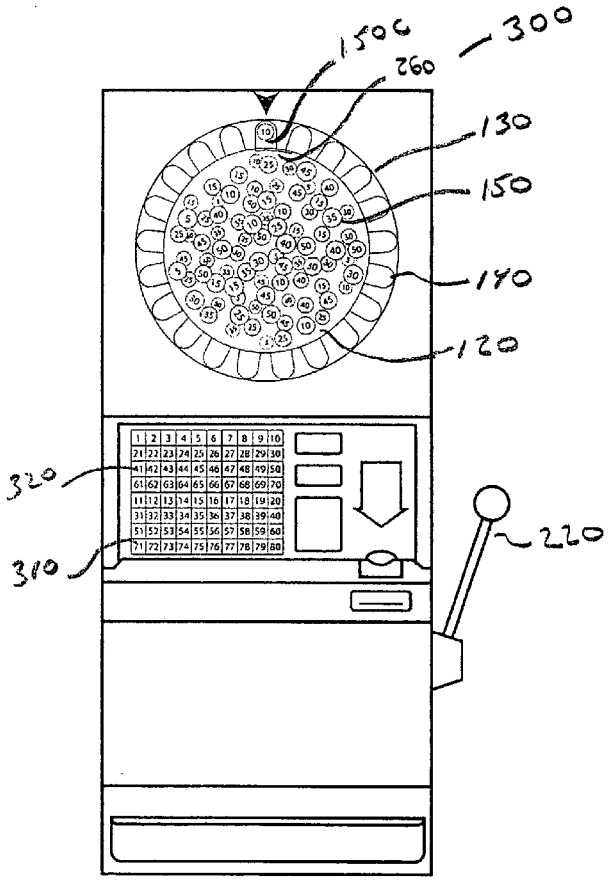
FIG. 5 shows a front view of a keno machine embodiment of the present invention.
Figure 6:
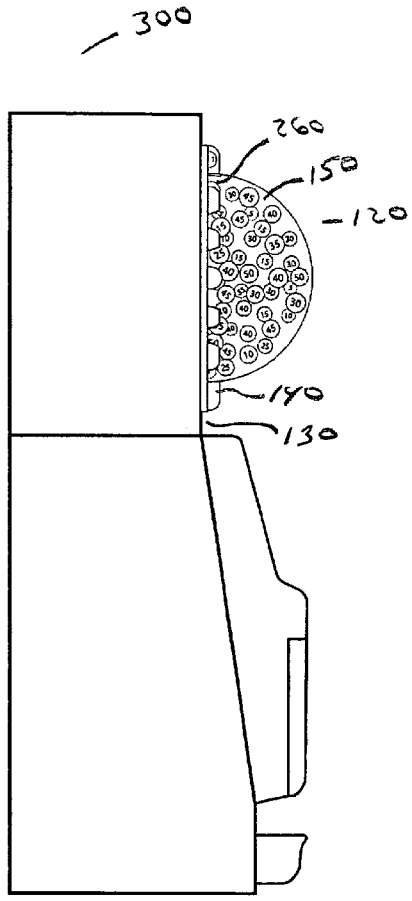
FIG. 6 shows a front view of the keno machine embodiment once a player has selected his or her keno numbers.
Figure 7:
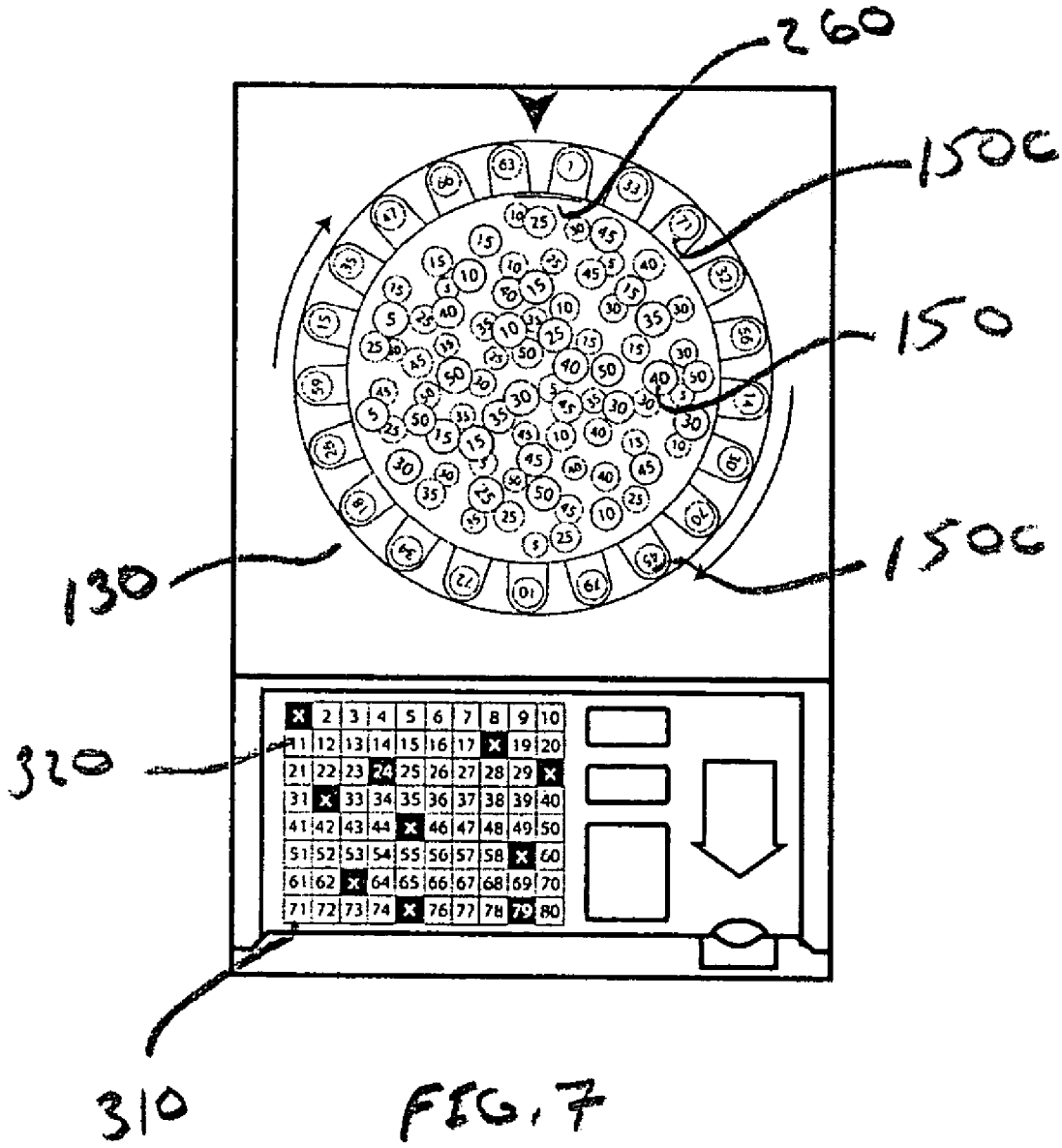
FIG. 7 shows a front view of the keno machine embodiment indicating which selected numbers have been matched by captured balls.

Now referring to FIGS. 5–7, a primary game takes the form of an electronic keno machine 300. Traditional electronic keno machines include a keno touchscreen for players to select keno numbers. Once the keno numbers are selected, a random number generator selects twenty numbers and highlights the randomly generated numbers on the keno touchscreen. Based on the number of matches between the selected numbers and the randomly generated numbers an award is determined. In the keno embodiment of the present invention, 80 numbered balls 150 each depict a unique numeral between 1–80. A keno touchscreen 310 provides means for a player to select a series of keno numbers 320. Once the player selects his or her keno numbers 320 via the keno touchscreen 310, the compartments 140 capture random balls 150 as described above. The keno numbers on the captured balls 150 are then compared to the selected keno numbers 320 to determine an award. In this arrangement, the container 120, rotatable wheel 130 and plurality of balls 150 may represent a primary game or secondary game.

The number of compartments 140 and balls 150 used with the keno embodiment is an arbitrary selection. That is, there may be twenty compartments 140 as shown or more or less depending on the choice of the manufacturer or casino.

Although numbered balls 150 have been discussed extensively, the balls may also depict symbols or other indicia, including one or more "WILD" balls. It is also possible that the keno embodiment may be integrated on a slot machine, video poker machine or the like in the form of a secondary game.

Moreover, although the invention has been described in detail with reference to a one or more embodiments, additional variations and modifications exist within the scope and spirit of the invention as described and defined in the following claims.

I claim:

1. A gaming machine comprising:

a container for holding a plurality of symboled balls;

an air source for agitating the symboled balls;

a plurality of compartments positioned about a circumference of said container, each said compartment for capturing one or more of said symboled balls in a random fashion; and one or more movable members providing said symboled balls with access to said compartments.

2. The gaming machine of claim 1 wherein a wheel positioned adjacent to said container supports said compartments.

3. The gaming machine of claim 2 wherein the wheel is rotatable.

4. The gaming machine of claim 1 having eighty symboled balls bearing a unique number between one and eighty, inclusive.

5. The gaming machine of claim 4 further comprising an interface for a player to select one or more keno numbers.

6. The gaming machine of claim 5 wherein an award is determined by the number of matches between the selected keno numbers and captured numbered balls.

7. The gaming machine of claim 1 further comprising one or more reels having gaming indicia depicted thereon.

8. The gaming machine of claim 1 further comprising one or more pointers for identifying one or more captured balls.

9. The gaming machine of claim 8 wherein the identified captured numbered balls are used to determine an award.

10. The gaming machine of claim 1 wherein one or more of the balls are designated a wild ball.

11. The gaming machine of claim 1 further comprising an air suction source for capturing said symboled balls.

12. A gaming machine comprising:

a primary game;

a secondary game including a container for holding a plurality of symboled balls, an air source for agitating said symboled balls and a wheel circumscribing said container, said wheel incorporating a plurality of compartments for capturing said symboled balls in a random fashion; and one or more access doors providing said symboled balls with access to said compartments.

13. The gaming machine of claim 12 wherein the wheel is rotatable.

14. The gaming machine of claim 12 wherein the primary game is selected from a group consisting of a slot machine, bingo machine, keno machine and video poker machine.

15. The gaming machine of claim 12 wherein the air source is activated in response to pre-established primary game outcomes.

16. The gaming machine of claim 12 further comprising a player interface for a player to input selected keno numbers.

17. The gaming machine of claim 16 wherein the container holds eighty balls each uniquely numbered between one and eighty, inclusive.

18. The gaming machine of claim 17 wherein an award is based on the number of matches between the selected keno numbers and the captured numbered balls.

19. The gaming machine of claim 12 further comprising one or more pointers adjacent to the container.

20. A gaming machine comprising:

a player interface for selecting one or more keno numbers;

a container for holding a plurality of numbered balls;

an air source for agitating said numbered balls;

a wheel including a series of compartments circumscribing said container, said compartments for capturing said numbered balls, and one or more movable members providing said numbered balls with access to said compartments.

21. The gaming machine of claim 20 wherein the wheel is rotatable.

22. The gaming machine of claim 20 wherein an award is based on the number of matches between the selected keno numbers and the captured numbered balls.

23. The gaming machine of claim 20 further comprising one or more access doors in proximity to the compartments.

24. The gaming machine of claim 20 further comprising a suction source for capturing said numbered balls.

25. A method for determining a gaming machine award comprising:

activating an air source to agitate a plurality of symboled balls within a container;

incrementally rotating a wheel incorporating a plurality of compartments, said wheel circumscribing said container;

capturing one or more of the agitated balls in the plurality of compartments incorporated on said wheel by rotating said compartments so that each compartment comes into contact with an access door which opens thereby permitting an air suction source to pull a random ball into the compartment; and identifying one or more of the captured numbered balls to determine the gaming machine award.

26. The method of claim 25 wherein the identifying one or more of the captured numbered balls is accomplished by one or more pointers positioned adjacent the container.

27. The method of claim 25 wherein the identified numbered balls are summed to determine the gaming machine award.

28. The method of claim 25 wherein the identified numbered balls act as multipliers of a primary game award.

29. The method of claim 25 further comprising affording a player an opportunity to select one or more keno numbers prior to the capturing of one or more agitated balls.

30. The method of claim 29 wherein the award is based on the number of matches between the selected keno numbers and the captured numbered balls.

31. The method of claim 25 further comprising the steps of rotating the wheel after the balls have been captured, stopping the wheel and identifying one or more of the captured balls as winning balls.

32. A method of playing an electronic keno gaming machine comprising:

affording a player an opportunity to select one or more keno numbers;

activating an air source to agitate a plurality of numbered balls within a container;

capturing a plurality of the agitated numbered balls in multiple compartments on a rotatable wheel circumscribing said container, said capturing facilitated by rotating said compartments so that each compartment comes into contact with an access door which opens thereby permitting an air suction source to pull a random ball into the compartment; and awarding the player a payout based on the number of selected keno numbers matching numbers on the captured balls.

* * * * *